US007271355B2

(12) United States Patent
Yu

(10) Patent No.: US 7,271,355 B2
(45) Date of Patent: Sep. 18, 2007

(54) LOCKING MECHANISM FOR A SAFETY SWITCH

(75) Inventor: Hyoungkeun Yu, Choongcheongnamdo (KR)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 11/265,060

(22) Filed: Nov. 1, 2005

(65) Prior Publication Data

US 2007/0095641 A1 May 3, 2007

(51) Int. Cl.
*H01H 9/28* (2006.01)

(52) U.S. Cl. ..... 200/17 R; 200/43.07; 200/334

(58) Field of Classification Search ..... 200/43.01, 200/43.04–43.13, 17 R, 334, 50.01, 61.62–68
See application file for complete search history.

(56) References Cited

U.S. PATENT DOCUMENTS 4,524,251 A * 6/1985 Schulz ..... 200/43.07
5,516,993 A * 5/1996 Wecke et al. ..... 200/17 R
5,587,569 A * 12/1996 Mohtasham ..... 200/17 R
5,703,339 A 12/1997 Rapp et al. ..... 200/17 R

FOREIGN PATENT DOCUMENTS

DE 19937947 A1 3/2001
DE 10041129 C1 12/2001
EP 0977228 A2 2/2000

* cited by examiner

*Primary Examiner*—Elvin Enad
*Assistant Examiner*—M. Fishman
(74) *Attorney, Agent, or Firm*—Luis M. Ortiz; Kermit D. Lopez

(57) ABSTRACT

A indexing wheel mounted in the head assembly of a safety switch has an axis of rotation extending at right angles to the longitudinal axis of the plunger, and against whose lateral surface the plunger bears. A key channel in the head assembly is adapted for receiving a key and into which the indexing wheel projects. A key, upon being inserted into and upon being withdrawn from the key channel positively rotates a cam plate about its axis of rotation and switches over the switch. The switch and key is maintained in locked status by action of the locking hole on the cam pin and by action of the plunger when a key is inserted into the head assembly where the plunger becomes inserted in the locking hole of the indexing wheel and/or the flank on the cam pin after rotation by the key causing the key and switch to become locked.

13 Claims, 3 Drawing Sheets

Key - Out

Key - In

LOCKING MECHANISM FOR A SAFETY SWITCH

TECHNICAL FIELD

The present invention is generally related to safety switches. More particularly, the present invention is related to locking mechanisms for safety switches. The invention is also related to use of locking holes on the axis of cam pins to lock safety switches.

BACKGROUND

Industrial limit switches, such as global limit switches, safety interlocks, safety solenoid interlocks and cable pull limit switches, are used in a wide variety of industrial applications. Limit switches contain switches that are manufactured to suit the particular application.

U.S. Pat. No. 5,703,339 issue to Rapp et al describes a modern safety switch. The safety switch described by Rapp et al uses a key which, when inserted into and removed from a key channel, forcibly rotates a cam plate and thereby switches the position of the switch.

The prior safety switch further has an interlocking device for the cam plate which is disposed adjacent the latter, and can be forcibly released by the key when it is introduced into the key channel and has at least one locking member which can be displaced in translation and, in its locked position, engages in an interlocking manner with a housing disposed adjacent the cam plate. The locking member can be displaced into the released position by the key by means of an actuating which is moveable together with the locking member and is integral therewith. The part of the actuating member which projects into the key channel in the locked position is connected to the locking member by means of a material section which is laterally guided past the axis of rotation.

Despite interlocking in the prior art, it has been determined that more effective locking associated with safety switches is required where it is desirable that the locking mechanism prevent a key from being extracted outside of switch.

SUMMARY OF THE INVENTION

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is one feature of this invention to provide a configurable switch that can be configured and locked.

It is another object of this invention to provide a configurable switch that contains a configurable locking plunger accommodating multiple moveable arrangements.

In accordance with features of the present invention, an indexing wheel mounted in the head assembly of a safety switch has an axis of rotation extending at right angles to the longitudinal axis of the plunger, and against whose lateral surface the plunger bears. A key channel in the head assembly is adapted for receiving a key and into which the indexing wheel projects. A key, upon being inserted into and upon being withdrawn from the key channel, positively rotates a cam plate about its axis of rotation and in so doing switches over the switch. The switch and key is maintained in locked status by action of the locking hole on the cam pin and by action of the plunger when a key is inserted into the head assembly where the plunger becomes inserted in the locking hole of the indexing wheel and/or the flank on the cam pin after rotation by the key causing the key and switch to become locked.

BRIEF DESCRIPTION OF THE DRAWINGS

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION OF THE INVENTION

The particular values and configurations discussed in these non-limiting examples can be varied and are cited merely to illustrate at least one embodiment and are not intended to limit the scope thereof.

Figure 1:
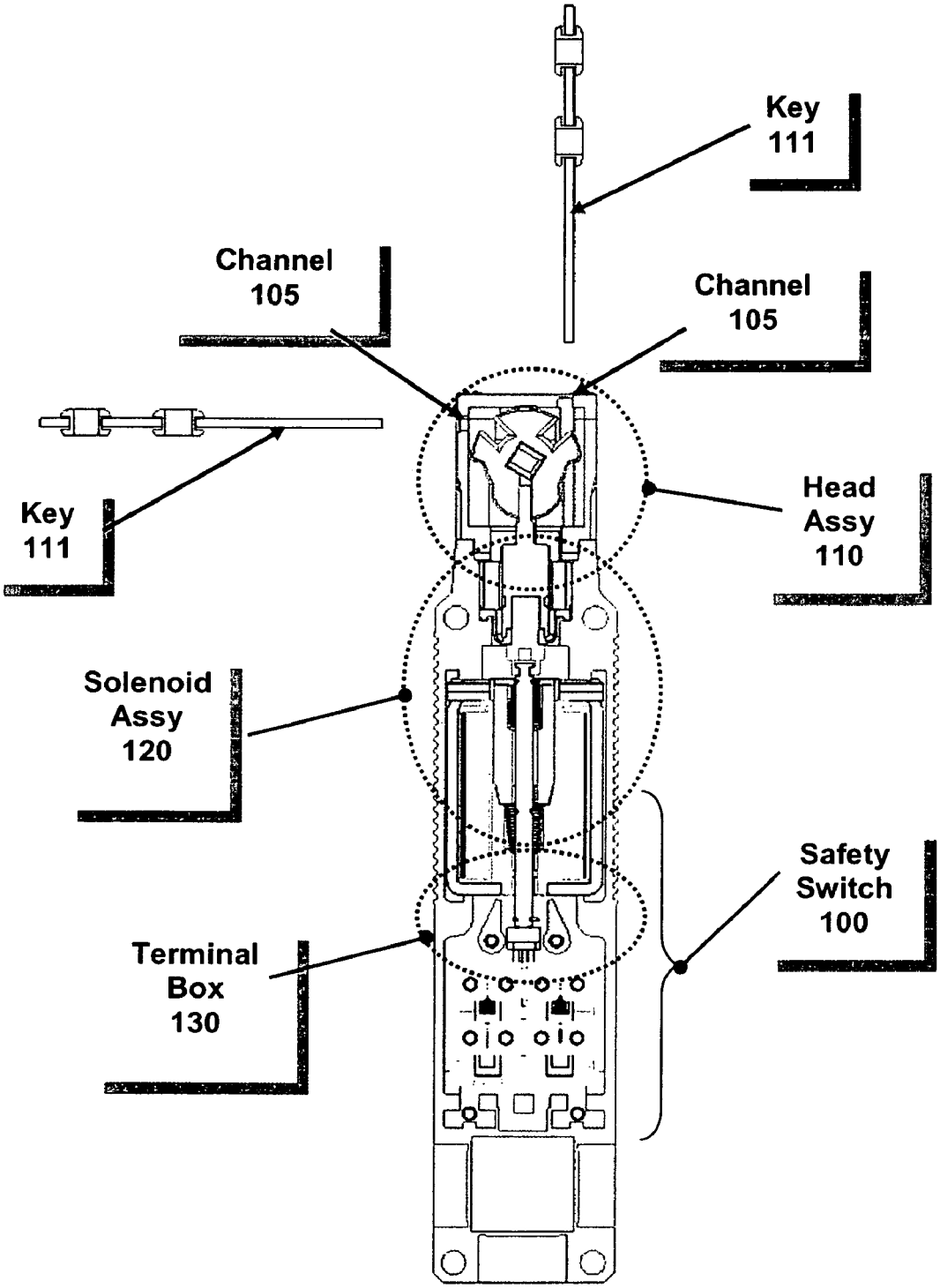
FIG. 1 illustrates a safety switch in accordance with the embodiment.
Figure 2:
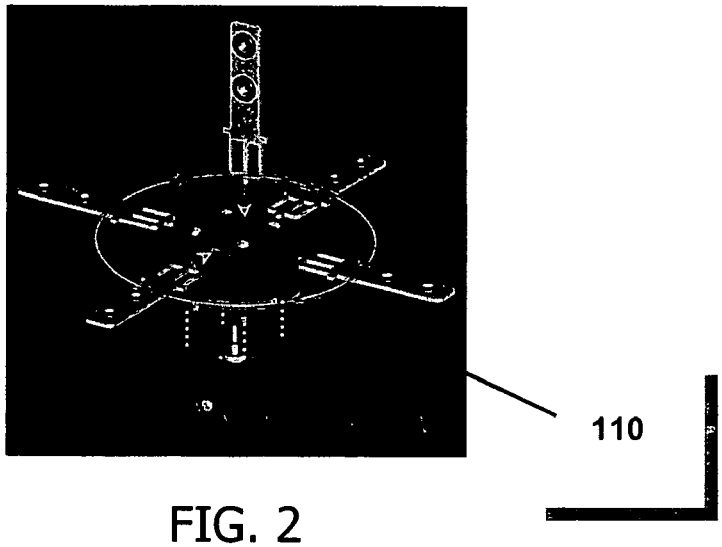
FIG. 2 illustrates a close view of the head assembly for the safety switch of FIG. 1 in accordance with the embodiment.

Referring to FIG. 1, a safety switch 100 in accordance with the embodiment. The safety switch 100 includes a head assembly 110, solenoid assembly 120 and a terminal box 130. The head assembly will preferably have at least one slot 105 adapted for receiving a key 111. Head assembly 110 can also be adapted to accept keys from several vantage points and be rotatable as shown in FIG. 2. When a key is inserted into the slot in the head assembly 110, the switch and whatever component it may control becomes activated.

Figure 3:
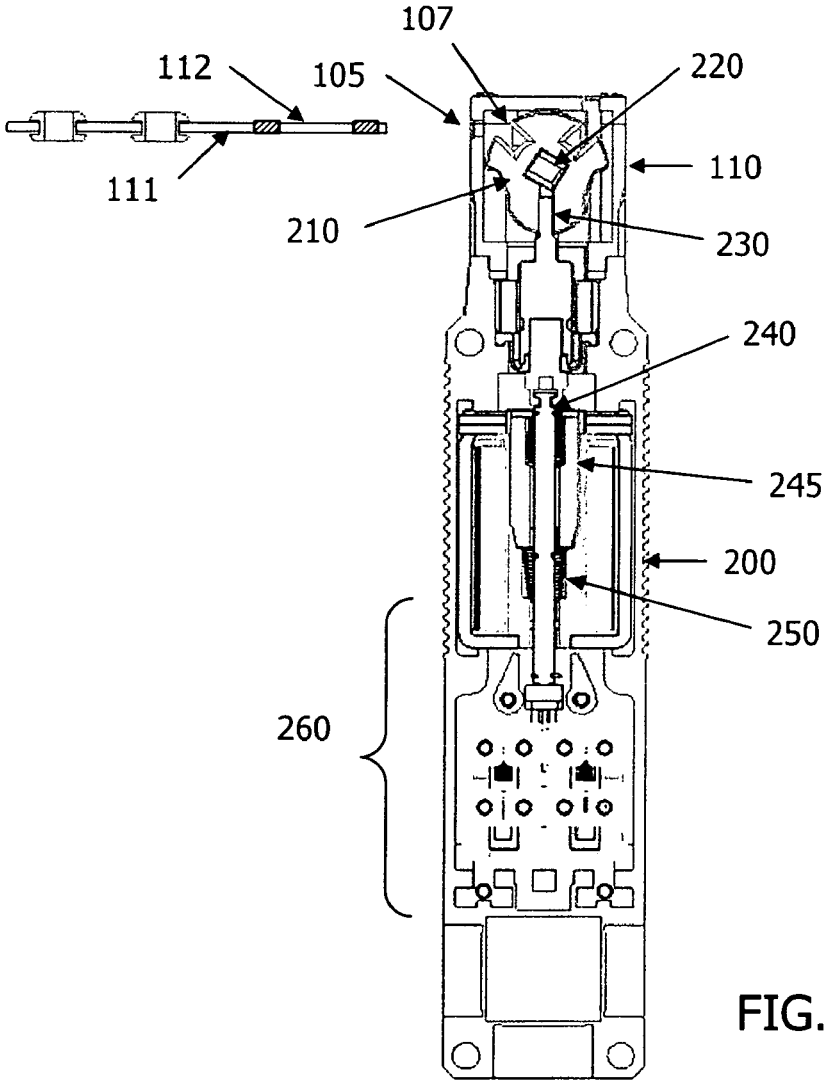
FIG. 3 illustrates a cross-sectional side view of the switch of FIG. 1 in accordance with embodiments.
Figure 4:
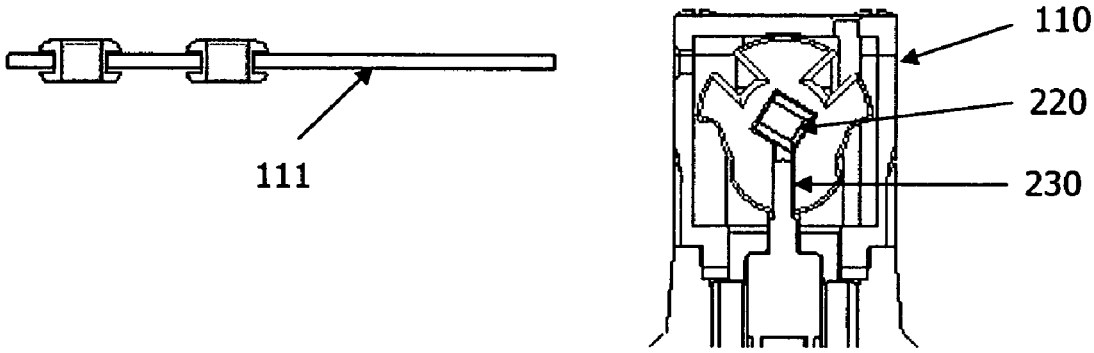
FIG. 4 illustrates a close up perspective view of the head assembly together with a slotted key, indexing wheel adapted with locking hole 220, and cam pin 230 all operational for activating and deactivating a switch 100 in accordance with embodiments.
Figure 4:
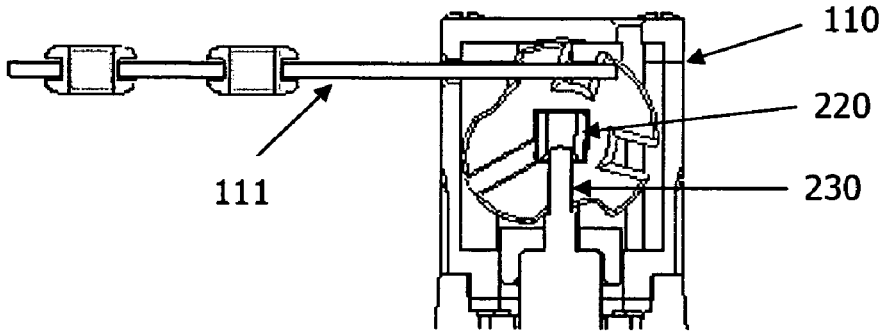

Referring to FIG. 3, a side, cut-away view of the switch housing 200 in accordance with the embodiment is illustrated wherein a key 111 is shown in position to be inserted into a key channel 105 of the head assembly 110. When the key 111 is inserted into a key channel 105 located in the head assembly 110, an indexing wheel 210 having a locking hole 220 on its axis, a cam pin 230, and a plunger 240 interact by action of the key 111 with the indexing wheel 210. The plunger 240 is arranged in the switch housing 200 in a fashion capable of displacement in its longitudinal direction against the force of a spring 250 for actuating the switch 260. The indexing wheel 210 is mounted in association with the head assembly with an axis of rotation extending at right angles to the longitudinal axis of the plunger 240, and against whose lateral surface the plunger bears. The indexing wheel 210 is adapted with at least one notch 107 which enables protruding portions of the indexing wheel on each side of the notch 107 to project into complimentary key slots 112 formed in the key 111 as the key is inserted into the key channel 105 formed in the head assembly 110. A close up perspective view of the head assembly 110 together with the slotted key 111, indexing wheel 210 adapted with locking hole 220, and the cam pin 230 is illustrated in FIG. 4

During use, a key 111, upon being inserted into and upon being withdrawn from the key channel 105, positively rotates the indexing wheel 210 about its axis of rotation and in so doing causes activation of the switch 260. The switch and key is maintained in locked status by action of the locking hole 220 on the cam pin 230 and by action of the plunger 240 when a key 111 is inserted into the head assembly 110 where the plunger 240 becomes inserted in the locking hole 220 of the indexing wheel 210 and the hole 220 on the cam pin 230 after rotation by the key 111 causing the key 111 to become locked by the indexing wheel 210 and wherein removal of the key disengages (deactivates) the switch. Locking prevents the key 111 from being extracted outside of head assembly 110 until the plunger 240 is released from its position within the indexing wheel 210.

An plunger 240 can be constructed in one piece with the cam pin 230 and an project into the key channel when in the locked position, wherein the part of the cam pin 230 which projects into the head assembly 110 in the locked position is connected to the indexing wheel 210 via the one piece actuating member comprising the combined plunger 240 and cam pin 230 as a unitary material part guided moving laterally at its point past the axis of rotation. Both the indexing wheel as well as the cam pin 230 and plunger 240 can be formed from plastic.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A safety switch assembly comprising:

a head assembly further comprising an indexing wheel having a locking hole on its axis, a cam pin, and a plunger, wherein the plunger is arranged in a switch housing in a fashion capable of displacement in its longitudinal direction against the force of a spring for actuating the switch when its movement is enable by longitudinal displacement of the cam pin into the locking hole in the indexing wheel and wherein the indexing wheel is mounted in association with the head assembly with an axis of rotation extending at right angles to the longitudinal axis of the cam pin and the plunger, and against whose lateral surface the cam pin bears; and a key channel formed in the head assembly and adapted for receiving a key.

2. The safety switch of claim 1, wherein the key which upon being inserted into and upon being withdrawn from the key channel positively rotates the indexing wheel about its axis of rotation and in so doing activates the switch.

3. The safety switch of claim 2, wherein the switch and the key are maintained in locked status by action of the cam pin into the locking hole on the indexing wheel and by action of the plunger on the cam pin when the key is inserted into the head assembly where the cam pin becomes inserted in the locking hole of the indexing wheel and a flank on the cam pin after rotation of the indexing wheel by the key causing the key to become locked and wherein removal of the key deactivates the switch.

4. The safety switch of claim 3, wherein locking prevents the key from being extracted outside of switch until the cam pin is released from its position from the indexing wheel.

5. The safety switch according to claim 3, wherein the cam pin and indexing wheel are plastic.

6. A safety switch comprising:

a head assembly further comprising an indexing wheel having a locking hole on its axis, a cam pin, and a plunger, wherein the plunger is arranged in the switch housing in a fashion capable of displacement in its longitudinal direction against the force of a spring for actuating the switch and wherein the indexing wheel is mounted in association with the head assembly with an axis of rotation extending at right angles to the longitudinal axis of the plunger, and against whose lateral surface the plunger bears; and a key channel formed in the head assembly and adapted for receiving a key , wherein the key upon being inserted into the key channel positively rotates the indexing wheel about its axis of rotation and in so doing activates the switch and wherein the key upon being removed from the key channel negatively rotates the indexing wheel about its axis of rotation and is so doing deactivates the switch.

7. The safety switch of claim 6, wherein the switch and the key is maintained in locked status by action of the locking hole on the cam pin and by action of the plunger when a key is inserted into the head assembly where the plunger becomes inserted in the locking hole of the indexing wheel and a flank on the cam pin after rotation by the key causing the key to become locked and wherein removal of the key disengages the switch.

8. The safety switch of claim 6, wherein locking prevents the key from being extracted outside of switch until the plunger is released from its position from the indexing wheel.

9. The safety switch according to claim 6, wherein the cam pin and indexing wheel are plastic.

10. A safety switch comprising:

a head assembly further comprising an indexing wheel having a locking hole on its axis, a cam pin, and a plunger, wherein the plunger is arranged in the switch housing in a fashion capable of displacement in its longitudinal direction against the force of a spring for actuating the switch when its movement is enable by longitudinal displacement of the cam pin into the locking hole in the indexing wheel and wherein the indexing wheel is mounted in association with the head assembly with an axis of rotation extending at right angles to the longitudinal axis of the cam pin and the plunger, and against whose lateral surface the cam pin bears; and a key channel formed in the head assembly and adapted for receiving a key and into which a cam plate projects; wherein the key which upon being inserted into and upon being withdrawn from the key channel positively rotates the indexing wheel about its axis of rotation and in so doing switches over the switch and wherein the switch and the key is maintained in locked status by action of the cam pin into the locking hole on the indexing wheel and by action of the plunger on the cam pin when the key is inserted into the head assembly where the cam pin becomes inserted in the locking hole of the indexing wheel and the flank on the cam pin after rotation of the indexing wheel by the key causing the key to become locked and wherein removal of the key from the key channel deactivates the switch.

11. The safety switch of claim 10, wherein locking prevents the key from being extracted outside of switch until the plunger is released from its position within the indexing wheel.

12. The safety switch of claim 10 further comprising an actuating member constructed in one piece with the locking member and projects into the key channel in the locked position, wherein the part of the actuating member which projects into the key channel in the locked position is connected to the locking member via a material part guided laterally past the axis of rotation.

13. The safety switch according to claim 10, wherein the cam pin and indexing wheel are plastic.

* * * * *